United States Patent [19]

Beuchat

[11] 4,144,816

[45] Mar. 20, 1979

[54] MISSILE SECURITY MECHANISM

[75] Inventor: Roger Beuchat, Gland, Switzerland

[73] Assignee: Mefina S.A., Fribourg, Switzerland

[21] Appl. No.: 782,031

[22] Filed: Mar. 28, 1977

[30] Foreign Application Priority Data

Apr. 6, 1976 [CH] Switzerland ..... 4284/76

[51] Int. Cl.[2] ..... F42C 1/04; F42C 15/34

[52] U.S. Cl. ..... 102/251; 102/254

[58] Field of Search ..... 102/78, 76 R, 76 P, 102/80

[56] References Cited

U.S. PATENT DOCUMENTS

| | | | |
|---|---|---|---|
| 2,360,043 | 10/1944 | Del Prato | 102/78 |
| 2,951,444 | 9/1960 | Hunt | 102/78 |
| 2,999,461 | 9/1961 | Apotheloz et al. | 102/78 X |
| 3,616,756 | 11/1971 | Simmen et al. | 102/76 R |

FOREIGN PATENT DOCUMENTS

| | | | |
|---|---|---|---|
| 1193856 | 5/1959 | France | 102/78 |

*Primary Examiner*—David H. Brown

*Attorney, Agent, or Firm*—Emory L. Groff, Jr.

[57] ABSTRACT

A missile security mechanism comprises a sliding rod having two axially spaced-apart grooves, a socket slidably mounted on the rod and having hooks able to engage in one of these grooves then the other, and an inertia-block in the form of a sleeve surrounding and locking the hooks in the groove in which they are engaged. The inertia-block is displaceable by inertia against the action of a biasing spring to free the hooks. A second spring biases the rod towards the socket, the rod being held by a pawl which is movable to free the rod in response to a given displacement of the inertia-block.

2 Claims, 1 Drawing Figure

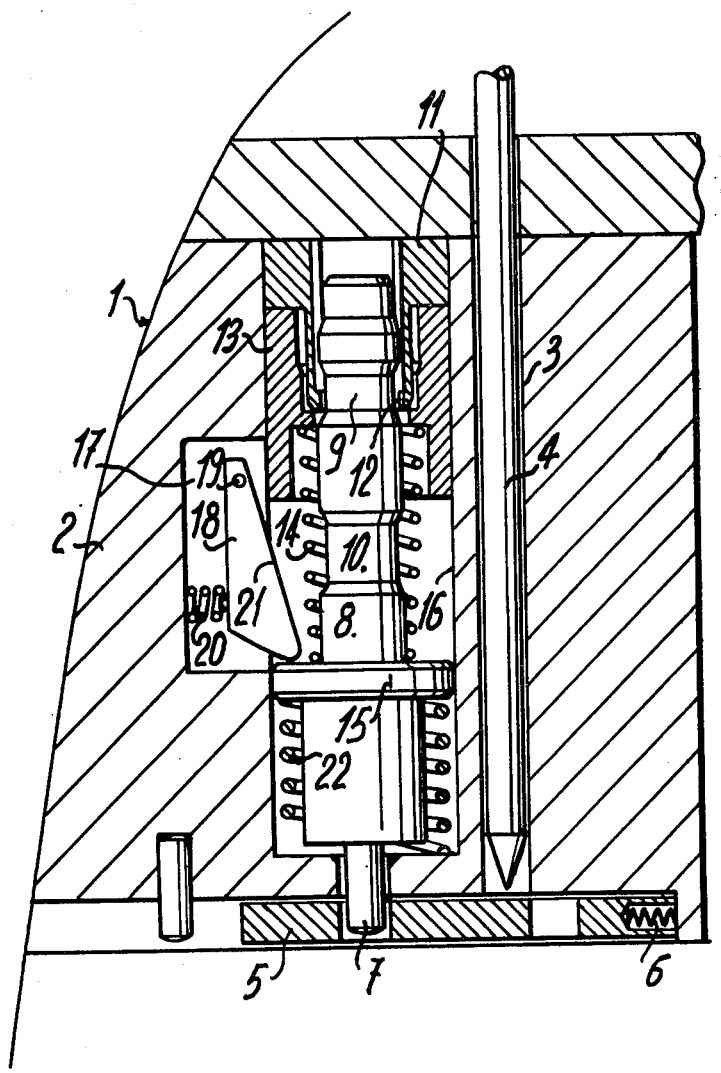
11
1
13
3
17
19
9
12
4
18
14
2
10.
21
8.
16
20
15
22
5
7
6

MISSILE SECURITY MECHANISM

The invention relates to security mechanisms for missiles.

A known security mechanism, for example described in the U.S. Pat. No. 3,616,756, comprises a sliding rod having two axially spaced-apart grooves, a socket slidably mounted on the rod and having hooks able to engage in one of the grooves then the other, an inertia-block in the form of a sleeve surrounding the hooks to lock them in the groove in which they are engaged, the inertia-block being slidably mounted and biased to a hook-locking position by a first spring and movable under the effect of acceleration of the missile by inertia against the action of the first spring to free the hooks, the rod being submitted to the action of a second spring urging it in the direction of the socket.

In a mechanism of this type, a faulty operation may occur in the case where, before use, the missile falls on a hard ground and its rear part touches the ground. Under the effect of such a shock, the inertia-block may move against the action of the first spring, and the rod may be pushed by the second spring in the direction of the socket if the second spring has a greater force than that required to space the elastic hooks apart from the socket. Thus, the mechanism does not fulfil its security function in the instance where the second spring has a relatively great force.

An object of the invention is to remedy this drawback. It concerns a mechanism of the stated type, comprising a member for retaining the rod against the action of the second spring, said member being movable to a position freeing the rod in response to a given displacement of a piece by inertia under the effect of acceleration of the missile.

The single FIGURE of the accompanying drawings shows, by way of example, an embodiment of the security mechanism according to the invention.

The security mechanism shown is fitted in a missile 1, only a part of which is shown. The missile 1 comprises a block 2 having a bore 3 in which a firing rod 4 is slidably mounted. The lower part of bore 3 is normally blocked by a transverse pin 5 able to slide under the action of a spring 6, but retained in the position shown in the drawing by engagement with an end 7 of a rod 8.

This rod 8 has two grooves 9 and 10 spaced axially from one another. The upper end of rod 8 is engaged in a socket 11 having integral hooks 12 which, in the position shown, engage in the groove 9 and are locked therein by an inertia-block 13 in the form of a sleeve which is urged into this hook-locking position by a spring 14.

The rod 8 has a portion 15 of increased diameter whose upper face forms a shoulder supporting the spring 14, whereas its lower face forms a support surface for a second spring 22. The other end of spring 22 bears against the bottom of a bore 16 of block 2.

The block 2 also has a lateral recess or housing 17 leading into the bore 16 and containing a pawl 18 pivoted at 19 and urged inwards, i.e. towards the rod 8, by a spring 20. A part of pawl 18 forms an inclined ramp 21 protruding into the bore 16 in the path of the inertia-block 13.

Operation of the security mechanism is as follows:

When the missile is shot, it is subjected to a strong axial acceleration so that, by inertia, the rod 8 comes to abut against the bottom of the bore 16, which removes pressure exerted by its part 15 on the pawl 18. At the same time, the inertia-block 13 moves towards the rear of the missile, compressing the spring 14. The displacement of the inertia-block 13 frees the elastic hooks 12 of socket 11 and pushes back the pawl 18 against the action of its spring 20. Following release of the hooks 12, the socket 11 also moves by inertia until the hooks 12 engage in groove 10 where they are held by the inertia-block 13 under the action of spring 14. The inertia-block 13 and sleeve 11 are thus held in a retracted position on the rod 8 allowing displacement of the rod 8 to free its end 7 from the pin 5, so that the firing rod 4 can pass through an opening in pin 5.

I claim:

1. A security mechanism for a missile, said mechanism comprising a sliding rod having two axially spaced-apart grooves, a socket slidably mounted on the rod and having hooks able to engage in one of these grooves then the other, and an inertia-block in the form of a sleeve surrounding said hooks to lock them in the groove in which they are engaged, said inertia-block being slidably mounted and biased to the hook-locking position by a first spring and movable under the effect of acceleration of the missile by inertia against the action of the first spring to free the hooks, a second spring biasing the rod in the direction of the socket, and a member for retaining the rod against the action of the second spring, said member being movable to a position freeing the rod in response to a given displacement of said interia-block by inertia under the effect of acceleration of the missile.

2. A mechanism according to claim 1, in which said member is a pawl cooperating with a shoulder of the rod, said pawl having a ramp-shaped part disposed in the path of the inertia-block in a manner to be moved by the inertia-block to free said shoulder.

* * * * *